United States Patent [19]

Olson et al.

[11] Patent Number: 4,503,752

[45] Date of Patent: Mar. 12, 1985

[54] HYDRAULIC PUMPING UNIT

[75] Inventors: Samson A. Olson, Olathe; George C. Williams, Prairie Village, both of Kans.

[73] Assignee: Hypex, Incorporated, Olathe, Kans.

[21] Appl. No.: 480,075

[22] Filed: Mar. 29, 1983

[51] Int. Cl.[3] ..... F15B 13/02; F01L 15/02

[52] U.S. Cl. ..... 91/48; 60/369; 91/50; 91/311; 91/318; 91/452

[58] Field of Search ..... 60/369, 371, 372; 91/50, 304, 461, 311, 318, 48, 452

[56] References Cited

U.S. PATENT DOCUMENTS

| | | | |
|---|---|---|---|
| 2,789,542 | 4/1957 | Vander Kaay | 91/48 |
| 2,934,899 | 5/1960 | Roplin et al. | 91/304 |
| 2,972,863 | 2/1961 | Hyde | 60/372 |
| 3,939,656 | 2/1976 | Goldfein | 60/456 |
| 3,986,355 | 10/1976 | Klaeger | 60/369 |
| 4,249,376 | 2/1981 | Weckerly | 60/369 |
| 4,321,855 | 3/1982 | Bacquie et al. | 91/452 |

FOREIGN PATENT DOCUMENTS

| | | | |
|---|---|---|---|
| 103906 | 6/1982 | Japan | 91/452 |
| 641177 | 1/1979 | U.S.S.R. | 91/452 |

*Primary Examiner*—Sheldon J. Richter
*Assistant Examiner*—Randolph A. Smith
*Attorney, Agent, or Firm*—Schmidt, Johnson, Hovey & Williams

[57] ABSTRACT

A hydraulic pumping unit is provided that is especially adapted for use for pumping oil from a well, and that provides for independent upstroke and downstroke speed control of the well sucker rod. The pumping unit includes a load sensing, pressure and flow compensated pump that is destroked under no load conditions, a pumping cylinder including a polished rod coupled to the sucker rod, and a unique hydraulic valving assembly that couples the hydraulic fluid pump with the pumping cylinder. The hydraulic valving assembly includes a cylinder control module for independent control of the rates at which the polished rod is raised and lowered, and a signal control module for indicating the upper and lower limits of polished rod travel within the pumping cylinder. The cylinder control module provides for soft turnaround of the polished rod, thereby guarding against stretching of the sucker rod and subsequent degradation of the unit's pumping capacity.

1 Claim, 1 Drawing Figure

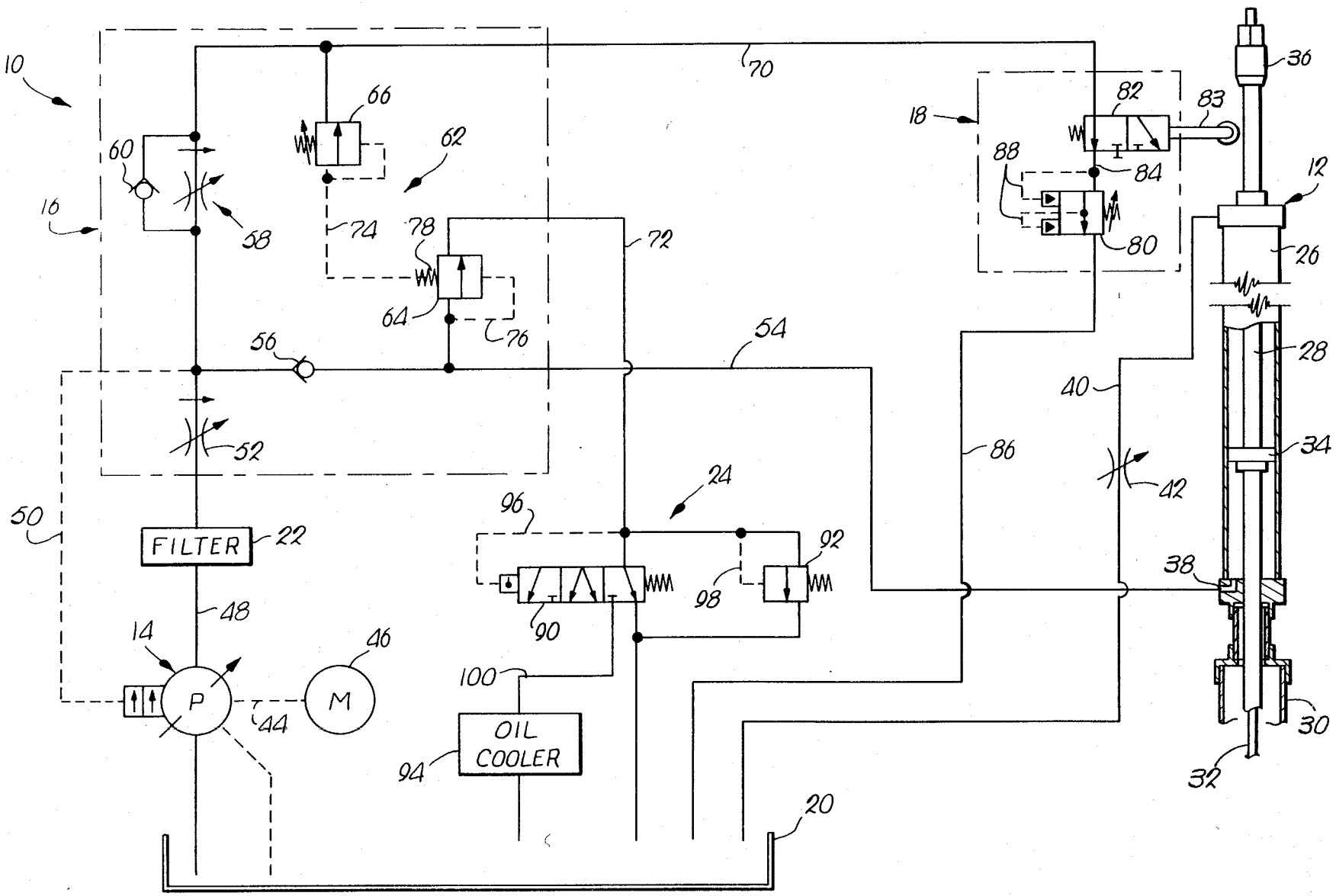
OIL COOLER
FILTER
M
P

HYDRAULIC PUMPING UNIT

BACKGROUND OF THE INVENTION

1. Field of the Invention

This invention relates to hydraulically actuated pumping devices. More particularly, it is concerned with a hydraulically actuated pumping unit that includes independent speed control for the upstroke and downstroke rates of the pump's polished rod. The pumping unit described herein is particularly well adapted for use in pumping oil from an oil well.

2. Description of the Prior Art

Oil well pumping units typically include a cam operated rocking arm coupled to a sucker rod that extends into the oil well. The pivotal motion of the rocking arm is converted to the back-and-forth pumping action of the sucker rod. A rocker arm must be of sturdy construction and generally comprises a significant dead weight which must be shifted along a path of travel during each pump cycle. Moreover, the rates at which the sucker rod is shifted along its upstroke and downstroke, when coupled to a conventional rocker arm, are both dependent upon the geometry of the rocker arm and cannot be independently varied. Also, the turnaround of the sucker rod between its downstroke and upstroke is dependent on the pivotal motion of the rocker arm, which leads to abrupt shifting of the sucker rod between the downstroke and the upstroke portions of its path of travel.

The above described characteristics of an oil well pumping unit having a conventional rocker arm lead to several disadvantages. First of all, the abrupt turnaround of the sucker rod leads to stretching of the sucker rod. As the sucker rod stretches, the pumping element attached to the sucker rod is correspondingly brought to successively lower heights within the oil well as the sucker rod is shifted to its uppermost position, and the suction stroke of the pumping element is therefore effectively reduced. Secondly, it is well known that an oil well pumping unit should be operated no faster than the recovery time of the oil well. That is to say, as oil is removed from the well, a certain time elapses before the well is again filled with oil. If the oil is pumped too fast relative to the well's recovery time, the well will run dry, and further operation of the pumping unit will waste the energy used to operate the pump, and may lead to pump unit damage. Operation of the pumping unit at a rate too slow relative to the well's recovery time will allow the well to fill with water as well as oil, and the water will accumulate within the lower portion of the well. It will be appreciated that the pump suction point is located in the lower portion of the well, and when water is accumulated in the lower portion of the well it will be removed by the well pumping unit rather than the oil.

It will therefore be appreciated that the rate at which an oil well pumping unit is operated is a critical factor in overall performance of the oil well. The pumping rate is difficult to control, however, when the rate of the pump's upstroke and downstroke are both dependent on the pivotal motion of a conventional rocker arm. This is particularly true when it is realized that the amount of oil removed from the well on each upstroke is in part dependent upon the rate at which the pumping element is shifted through its upstroke. If the upstroke rate is too slow, the amount of oil shifted per pumping unit upstroke will fall off drastically.

An oil well pumping unit that was not required to shift the dead weight of a rocker arm on each pumping cycle, and which provided for independent control of the rates at which the sucker rod was shifted through its upstroke and downstroke would be a decided advantage.

SUMMARY OF THE INVENTION

The problems described above are in large measure solved by the hydraulically actuated pumping unit in accordance with the present invention. That is to say, the pumping unit hereof is especially adapted for the pumping of oil from oil wells, and yet does not use a conventional rocker arm. Moreover, the pumping unit hereof provides for independent control of the rates at which the sucker rod and pumping element are shifted through their upstroke and downstroke paths of travel.

The hydraulic pumping unit in accordance with the present invention includes a pumping cylinder having a shiftable polished rod received therein for connection to the sucker rod of an oil well, a hydraulic pump for pressurizing motive fluid, hydraulic pressure lines for directing the pressurized motive fluid to and from the pumping cylinder, and flow control valves for controlling the rate at which pressurized motive fluid is supplied to and exhausted from the pumping unit's pumping cylinder.

BRIEF DESCRIPTION OF THE DRAWING

FIG. 1 is a generally schematic diagram of a hydraulic pumping unit in accordance with the present invention, the pumping cylinder of the pumping unit depicted in a fragmentary, sectional view.

DETAILED DESCRIPTION OF THE DRAWING

Referring to the drawing, a hydraulic pumping unit 10 in accordance with the present invention is depicted in schematic form. The pumping unit 10 includes a pump cylinder 12, fluid pump 14, cylinder control module 16, signal control module 18, reservoir 20, filter 22, thermal control unit 24, and a plurality of fluid directing conduits.

The cylinder 12 includes an outer casing 26 and a polished rod 28, and is positioned on the well head 30 of an oil well. The polished rod 28 is coupled to the oil well sucker rod 32. Sealing member 34 is fixedly positioned on the polished rod 28, as is an uppermost cam member 36. The outer casing 26 includes a lowermost fluid inlet port 38, and an air discharge line 40 connected to the upper portion of casing 26. Discharge line 40 includes variable needle valve 42, and connects the casing 26 to the reservoir 20.

Pump 14 comprises a load sensing, pressure and flow compensated hydraulic pump. The pump 14 is connected by a flexible coupling 44 to an electric or gasoline powered prime mover 46. Pump 14 is connected to the cylinder control module 16 via conduit 48, and by pressure sensing line 50.

Cylinder control module 16 includes motive fluid supply valve 52 comprising a pressure compensated flow control valve. Valve 52 is connected to the cylinder 12 via conduit 54 and check valve 56. Conduit 54 also connects valve 52 with a flow limiting, pressure compensated flow control valve 58. Valve 58 includes check valve 60.

The cylinder control module 16 also includes exhaust flow control valve assembly 62. Assembly 62 includes non-adjustable sequence valve 64 and relief valve 66. Valve 66 is connected to the signal control module 18 via conduit 70, and valve 64 is connected to the reservoir 20 via conduit 72 and thermal control unit 24. Valves 66 and 64 are interconnected by conduit 74.

Signal control module 18 includes cylinder reversal valve 80 comprising a kick down relief valve designed to remain in the open position until zero flow is attained, and cam operated reset valve 82. Valve 82 includes cam operated actuating rod 83. Valves 80, 82 are interconnected by conduit 84, and valve 80 is connected to reservoir 20 via conduit 86. Valve 80 includes sensing lines 88.

Reservoir 20 is schematically depicted as being open to the atmosphere, but may advantageously comprise a closed tank to protect against contamination of the motive fluid and air contained therein.

Thermal control unit 24 includes a thermal bypass valve 90, relief valve 92, and air cooled oil cooler 94. Valve 90 includes sensing line 96, and valve 92 includes sensing line 98. Valve 90 and oil cooler 94 are interconnected by conduit 100.

In operation, the pumping unit is initiated by connecting the prime mover 46 to a source of actuating power. The upstroke control valve 52 is opened to a desired setting and the pump 14 will come on line. Those skilled in the art will appreciate that the stroke of the pump 14 will be sensitive to the pressure sensed by line 50 such that the power consumed by the pump 14 is in direct relationship to the load placed on the pump. The motive fluid pressurized by the pump 14 is hydraulic oil. The oil is cleansed as it passes through filter 22.

The non-adjustable sequence valve 64 will be in a closed position as the pumping unit 10 commences its upstroke. The motive fluid is therefore directed through check valve 56 via conduit 54 to the inlet port 38 of pump cylinder 12. Sealing member 34 and polished rod 28 are shifted from a first, lower position toward a second, uppermost position within the cylinder casing 26 as pressurized fluid is introduced into the casing.

Needle valve 42 presents a restricted orifice through which the air in casing 26 must flow as the sealing element 34 is raised within the cylinder casing. The air within the cylinder casing 26 is therefore compressed as the sealing member 34 is raised, and the pressure exerted by the air within the cylinder may be controlled by adjusting needle valve 42. As the air within the pump cylinder 12 is compressed, the pressure of the motive fluid required to raise the polished rod 28 will accordingly be increased.

The above described increase in motive fluid pressure will be sensed by the signal control module 18. In this regard, it will be seen that the control module 18 is connected to the cylinder inlet port 38 via conduit 70, valve 58 and conduit 54. Valve 58 comprises a flow restricting valve, and line 70 is in essence a pressure sensing line. The reset valve 82 is biased into a normally open position as the polished rod 28 is shifted upwardly, and the pressure of the motive fluid is therefore communicated to the kick down valve 80.

Kick down valve 80 is advantageously set to shift from its normally closed to an open position once the pressure of the motive fluid is about 200 psi greater than the pressure of the motive fluid required to shift the polished rod 28 upwardly within the pump cylinder 12. Valve 80 will remain open until there is no further flow therethrough. In this regard, it will be remembered that the air within the cylinder casing 26 is compressed as the polished rod 28 is shifted upwardly, thereby causing the increase in pressure of the motive fluid required to lift the polished rod.

Shifting of valve 80 to an open position connects conduit 70 directly to reservoir 20, venting the pressure within conduit 70. Venting of the pressure within conduit 70 allows relief valve 66 to shift from its normally closed to an open position, thereby venting the spring chamber of the non-adjustable sequence valve 64 via line 74. In this regard, it will be appreciated that the valve 66 is a pilot operated relief valve set to open upon the venting of line 70. The degree to which valve 66 is opened may be selectively varied by adjusting the biasing pressure of the spring chamber of valve 66.

Shifting of valve 66 to an open position vents the spring chamber 78 of valve 64 as described above, and the valve 64 will shift from its normally closed position to an open position. The degree of opening of valve 64 is directly controlled by valve 66. As valve 64 opens, conduit 54 is connected to the reservoir 20 via the valve 64 and conduit 72, thereby allowing the motive fluid within the pump cylinder 26 to exhaust to the reservoir 20. The rate at which the motive fluid within the cylinder 26 is exhausted will depend upon the degree of opening of valve 64.

The motive fluid exhausted through valve 64 and conduit 72 passes through the thermal control unit 24. Valve 90 of thermal unit 24 is normally positioned as depicted in the drawing. As the temperature of the hydraulic motive fluid increases, however, valve 90 will shift rightwardly such that the motive fluid is transferred from valve 90 to the oil cooler 94, rather than being sent directly to the reservoir 20. Valve 92 acts as a safety relief valve and shifts from its normally closed position to an open position when the pressure in conduit 72 reaches a predetermined maximum limit.

The first and second flow control valving apparatus, comprising valve 52 and valve assembly 62 respectively, permit individual adjustment of the rate at which the polished rod 28 is raised and lowered within the cylinder casing 26. Valve 52 may be set to increase or decrease the upstroke rate of polished rod 28 without affecting the down stroke rate of the polished rod, and the valve assembly 62 may be set to adjust the rate at which the polished rod descends within the pump cylinder. Moreover, it is to be appreciated that the nonadjustable sequence valve 64 has a relatively slow reaction time. That is to say, the valve 64 shifts between its open and normally closed position at a relatively slow rate. Valve 64 therefore effectively presents a cushion acting against the rapid descent of the polished rod 28 within the pump cylinder casing 26 as the polished rod 28 approaches its lowermost position within the cylinder. The pumping unit 10 hereof, therefore, provides for a soft turn around of the polished rod between its downstroke and upstroke, mitigating against stretching of the polished rod and sucker rod.

Kick down valve 80 is designed to stay in the open position until there is zero flow of fluid through the valve. A no flow condition through the valve 80 is accomplished by the shifting of valve 82 from its normally open to a closed position. Shifting of the valve 82 to its closed position is accomplished by the interaction of cam 36 on polished rod 28 with the actuating rod 83 of the valve 82. Contact of the cam 36 with the actuating rod 83 of valve 82 is effected when the polished rod 28 is at its lowermost point of travel within the pump cylinder 26.

We claim:

1. A hydraulic pumping unit including:

a pump cylinder having an element shiftable between first and second positions received therein;

means for pressurizing motive fluid;

means operably coupling said cylinder and said pressurizing means for directing pressurized motive fluid to said cylinder for subsequent shifting of said element from said first position toward said second position;

first flow control means operably coupled to said directing means for selectively varying the rate at which said motive fluid is directed to said cylinder, thereby controlling the rate at which said element is shifted toward said second position;

means operably coupled to said cylinder for exhausting motive fluid from said cylinder, for subsequent shifting of said element from said second position toward said first position;

second flow control means operably coupled to said exhausting means for selectively varying the rate at which said fluid is exhausted from said cylinder, thereby controlling the rate at which said element is shifted toward said first position, said second flow control means comprising a non-adjustable sequence valve and pressure sensing relief valve operably coupled to said sequence valve for actuation of said sequence valve;

said first and second control means being variable independent from each other such that the rates at which said element shifts toward said first and second positions are individually controllable; and a reset valve normally open as the element is shifted toward said second position and a kick down valve in communication with said reset valve and shiftable from a closed to an open position upon there being a predetermined pressure on said motive fluid as the element is moved from said first position to said second position, the kick down valve remaining open until there is no further flow therethrough, the kick down valve being operably connected to said second flow control means, whereby opening of said kick down valve causes controlled exhaustion of said motive fluid from said cylinder after said element has reached the uppermost limit of its path of travel.

* * * * *